US009908590B2

(12) United States Patent
Foster et al.

(10) Patent No.: US 9,908,590 B2
(45) Date of Patent: Mar. 6, 2018

(54) AQUA LIFT

(71) Applicant: NORTHEAST AQUA LIFT LLC, New Hartford, CT (US)

(72) Inventors: William Foster, Mystic, CT (US); Thomas Blake Powell, Noank, CT (US); John Casey, New Hartford, CT (US)

(73) Assignee: NORTHEAST AQUA LIFT LLC, New Hartford, CT (US)

( * ) Notice: Subject to any disclaimer, the term of this patent is extended or adjusted under 35 U.S.C. 154(b) by 99 days.

(21) Appl. No.: 14/844,273

(22) Filed: Sep. 3, 2015

(65) Prior Publication Data

US 2016/0121971 A1 May 5, 2016

Related U.S. Application Data

(60) Provisional application No. 62/049,111, filed on Sep. 11, 2014.

(51) Int. Cl.
*B63B 1/10* (2006.01)
*B63B 7/06* (2006.01)
(Continued)

(52) U.S. Cl.
CPC ..... *B63B 1/125* (2013.01); *B63B 7/06* (2013.01); *B63B 29/00* (2013.01); *B63B 35/00* (2013.01); *B63B 35/34* (2013.01); *B63B 43/14* (2013.01); *B63B 2043/145* (2013.01); *B63B 2747/00* (2013.01)

(58) Field of Classification Search
CPC ..... B63B 1/125; B63B 35/00; B63B 43/14; B63B 2043/145; B63B 2747/00; B63B 1/121; B63B 2001/123; B63B 7/00; B63B 7/02; B63B 7/04; B63B 7/06; B63B 2007/065; B63B 7/08; B63B 35/34;
(Continued)

(56) References Cited

U.S. PATENT DOCUMENTS 1,132,924 A * 3/1915 Gepack ..... B63B 43/14 114/123
1,710,625 A * 4/1929 Kapigian ..... B63B 43/14 114/123
(Continued)

FOREIGN PATENT DOCUMENTS

WO WO 2005051757 A1 * 6/2005 ..... B63B 43/14

*Primary Examiner* — Ajay Vasudeva
(74) *Attorney, Agent, or Firm* — Cantor Colburn LLP

(57) ABSTRACT

A watercraft configured for use in a body of water is provided including a deck and at least one propulsion mechanism mounted at a first end of the deck. The at least one propulsion mechanism is configured to move the watercraft within the body of water. A man lift movable between a lowered position and a raised position is mounted to the deck. The man lift is configured to raise a person a vertical distance above the deck. Mounting brackets are arranged adjacent a first and second side of the deck. The mounting brackets are translatable between a retracted position and a deployed position. In the deployed position, the mounting brackets extend perpendicularly from the first side and the second side, respectively. An inflatable pontoon is removably coupled to each of the mounting brackets.

14 Claims, 8 Drawing Sheets

(51) Int. Cl.

| | |
|---|---|
| ***B63B 35/34*** | (2006.01) |
| ***B63B 43/14*** | (2006.01) |
| ***B63B 1/12*** | (2006.01) |
| ***B63B 29/00*** | (2006.01) |
| ***B63B 35/00*** | (2006.01) |

(58) Field of Classification Search
CPC ..... B63B 35/36; B63B 35/38; B63B 43/04; B63B 43/10; B63B 29/00
USPC ..... 114/61.15–61.19, 123, 360
See application file for complete search history.

(56) References Cited

U.S. PATENT DOCUMENTS 3,844,241 A * 10/1974 Black ..... B63B 43/14 114/123
3,942,458 A * 3/1976 Hankin ..... B63B 15/00 114/71
3,978,805 A 9/1976 Thomas
4,297,961 A * 11/1981 Johnson, Jr. ..... B63B 35/44 114/123
4,364,322 A * 12/1982 van Roon ..... B63B 15/00 114/71
5,038,697 A 8/1991 Farrier
5,089,120 A * 2/1992 Eberhardt ..... C02F 1/66 114/124
5,235,925 A 8/1993 Farrier
5,237,947 A 8/1993 Manning
5,253,731 A 10/1993 Moog
5,787,832 A 8/1998 Spinka
5,829,376 A 11/1998 Kostanski
5,988,090 A 11/1999 Barker, Jr.
6,029,598 A 2/2000 Stoll
6,073,568 A 6/2000 Finley
6,582,264 B2 6/2003 Brown
6,598,702 B1 7/2003 McGillewie et al.
6,698,371 B1 † 3/2004 Stoltzfus
6,874,440 B1 4/2005 Manderfeld
6,988,456 B1 1/2006 Schooler
7,082,887 B2 8/2006 Fuller
7,536,966 B2 * 5/2009 Stryjewski ..... B63B 7/04 114/61.1
7,644,674 B1 1/2010 Goldston
7,650,847 B1 1/2010 Wicks et al.
7,677,838 B2 3/2010 Matsuura et al.
7,814,854 B2 10/2010 Jouffroy
2010/0216357 A1 8/2010 Hanslow et al.

* cited by examiner
† cited by third party

AQUA LIFT

CROSS-REFERENCE TO RELATED APPLICATIONS

This application claims the benefit of U.S. provisional patent application Ser. No. 62/049,111, filed Sep. 11, 2014, the entire contents of which are incorporated herein by reference.

BACKGROUND OF THE INVENTION

This invention relates to watercrafts and, more specifically, to a watercraft having a man lift configured to raise a person vertically above the deck of the watercraft.

Inspection of structures, such as the underside of highway bridges for example, is federally mandated. There must therefore be a way to gain access to the structure below the roadway. Bridge inspections are commonly performed by any of walking on the ground, using a ladder or conventional bucket truck, or for bridges high above rivers, by using articulating cranes with platforms or buckets on them.

Boats have been used to access the underside of bridges. However, the makeshift lift devices on such boats are often unstable, especially when the boat is positioned in an area experiencing waves or significant tidal changes. As a result, the lift device must often be disassembled before the boat is moved to another location.

Accordingly, a boat capable of safely moving short distances within a body of water such that a man lift thereof remains in the lifted position while the boat is repositioned is desirable.

BRIEF DESCRIPTION OF THE INVENTION

According to one embodiment of the invention, a watercraft configured for use in a body of water is provided including a deck and at least one propulsion mechanism mounted at a first end of the deck. The at least one propulsion mechanism is configured to move the watercraft within the body of water. A man lift movable between a lowered position and a raised position is mounted to the deck. The man lift is configured to raise a person a vertical distance above the deck. Mounting brackets are arranged adjacent a first and second side of the deck. The mounting brackets are translatable between a retracted position and a deployed position. In the deployed position, the mounting brackets extend perpendicularly from the first side and the second side, respectively. An inflatable pontoon is removably coupled to each of the mounting brackets.

According to another embodiment of the invention, a method of stowing a watercraft is provided including moving a man lift of the watercraft to a lowered position. Inflatable pontoons removably coupled to mounting brackets of the watercraft are deflated. The pontoons are detached from the mounting brackets, and the mounting brackets are moved from a deployed position to a retracted position such that the mounting brackets are at least partially received within a complementary opening formed in the deck.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
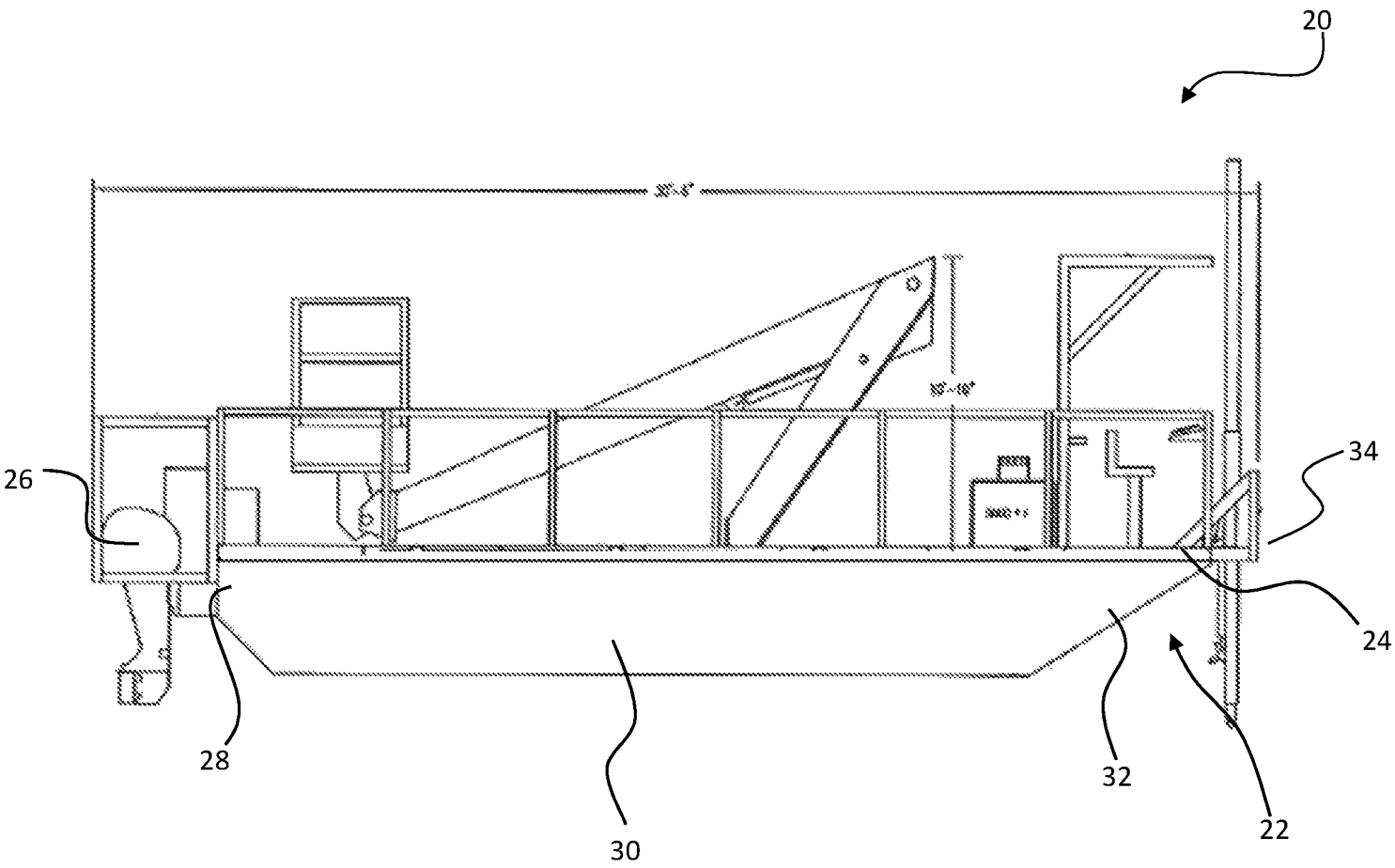
FIG. 1 is a side view of a watercraft in a stowed position according to an embodiment of the invention.

The detailed description explains embodiments of the invention, together with advantages and features, by way of example with reference to the drawings.

DETAILED DESCRIPTION OF THE INVENTION

Referring now to the FIGS., a watercraft 20 is illustrated in more detail. The watercraft 20 includes a hull 22 having a flat, generally rectangular deck 24. One or more propulsion mechanisms 26, such as outboard motors for example, are arranged at a first end 28, such as the stern for example, of the watercraft 20 and are configured to propel the watercraft 20 through a body of water.

The hull 22 of the watercraft 20 includes at least two main pontoons 30 mounted to the underside of deck 24. The main pontoons 30 are elongated flotation devices having a buoyancy sufficient to keep a heavy load connected thereto afloat. The main pontoons 30 are commonly formed from a sheet metal material, such as marine grade aluminum for example. In the illustrated, non-limiting embodiment of FIG. 3, the main pontoons 30 have a substantially square cross-section and extend from the first end or stern 28, towards the second, opposite end or bow 34, over at least a portion of the length of the watercraft 20. The cross-section of the main pontoons 30 may be substantially constant over the length of the watercraft 20, or alternatively, as shown in FIG. 1, a front portion 32 of the main pontoons 30 may be gradually reduced, tapered, or inclined upwardly towards the bow 34.

Figure 3:
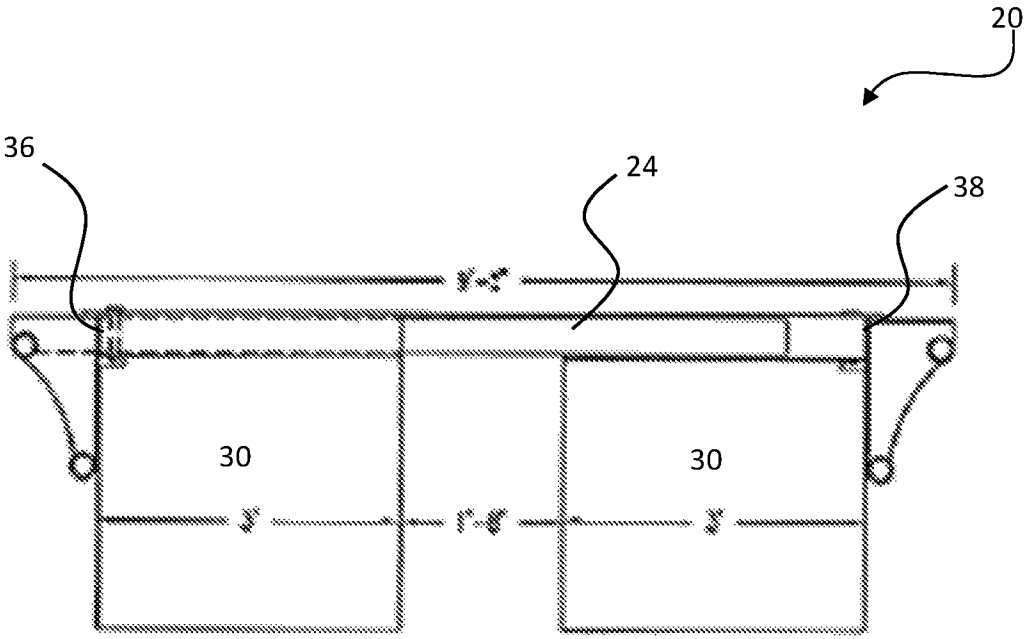
FIG. 3 is cross-sectional view of a watercraft in a stowed position according to an embodiment of the invention.
Figure 4:
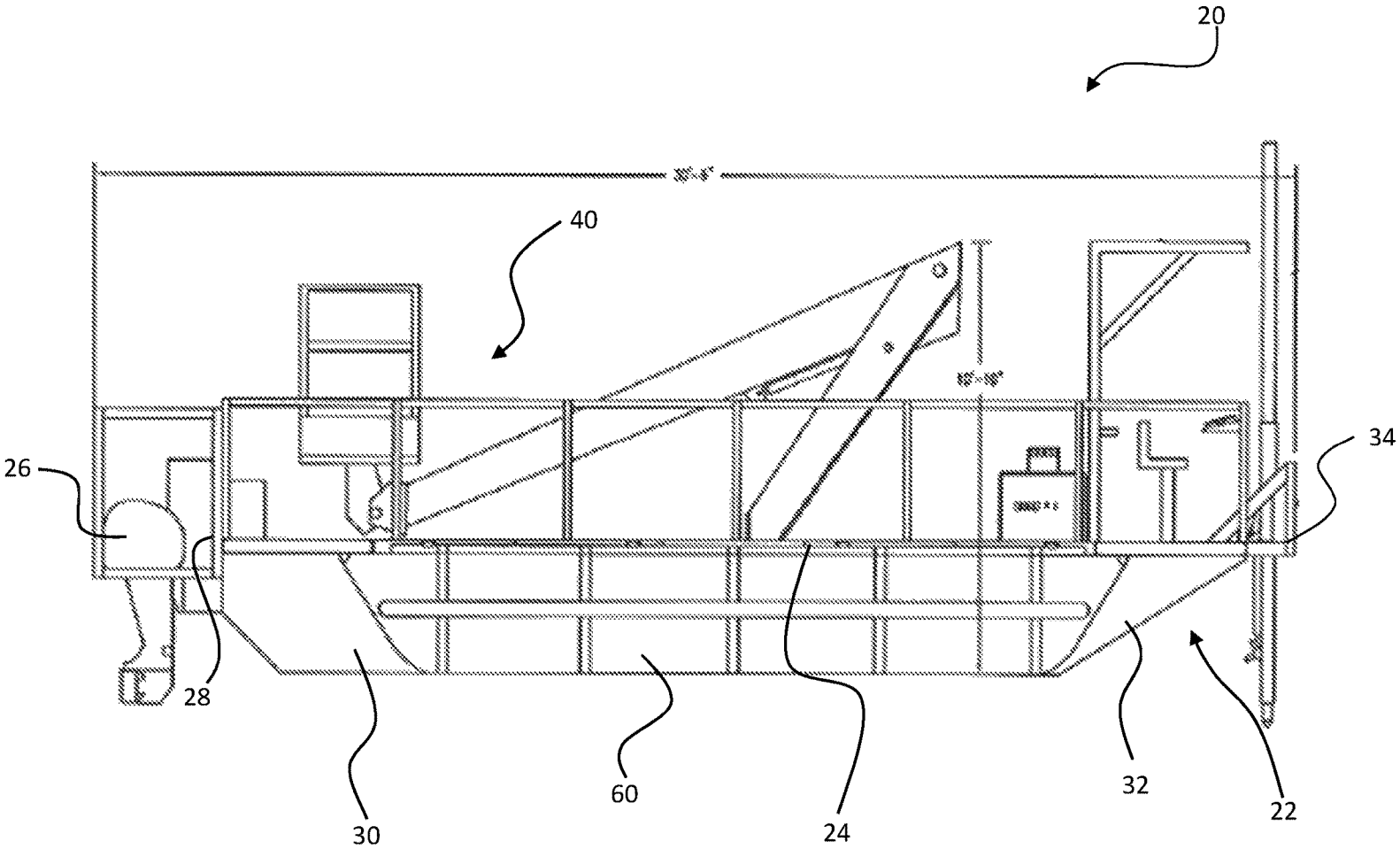
FIG. 4 is a side view of a watercraft in a deployed position according to an embodiment of the invention.

In the illustrated, non-limiting embodiment, the pair of main pontoons 30 are substantially identical and are generally arranged adjacent a first, starboard side 36 of the watercraft 20 and a second, port side 38 of the watercraft 20, respectively (see FIG. 3). However, configurations of the watercraft 20 including additional main pontoons 30, such as three equally spaced main pontoons for example, are within the scope of the invention. In such configurations, the main pontoons 30 need not be substantially identical.

Mounted to the deck 24 of the watercraft 20 is a man lift 40. The man lift 40 may be any type of device configured to move and support a person vertically above the deck 24, such as an aerial work platform for example. In the illustrated, non-limiting embodiment, the man lift 40 is arranged generally centrally between the starboard and port sides 36, 38 of the watercraft 20. However, in other embodiments, the man lift 40 may be located at any position on the deck 24.

The man lift 40 is movable between a lowered position (as shown in the FIGS.) and a raised position (not shown), such as to perform overhead work when the watercraft 20 is arranged underneath a bridge for example. When the watercraft 20 is being stored or transported, or even when the watercraft 20 is arranged within a body of water but is not being used to perform an inspection or other maintenance work, the man lift 40 is generally kept in the lowered position. In one embodiment, the man lift 40 is configured to move a person up to sixty feet vertically between the lowered position and the raised position. However, man lifts 40 configured to move any vertical distance are within the scope of the invention.

A mounting bracket or outrigger 50 is arranged at both the starboard side 36 and the port side 38 of the watercraft 10. The mounting brackets 50 may extend over a portion of the length of the watercraft 20, or alternatively, may extend over the full length of the watercraft 20. Each mounting bracket 50 includes a plurality of support members 52 arranged perpendicularly to the sides 36, 38 of the watercraft 20 and at least one connection member 54 oriented substantially parallel to the sides 36, 38 of the watercraft 20 and configured to connect the plurality of support members 52.

Figure 2:
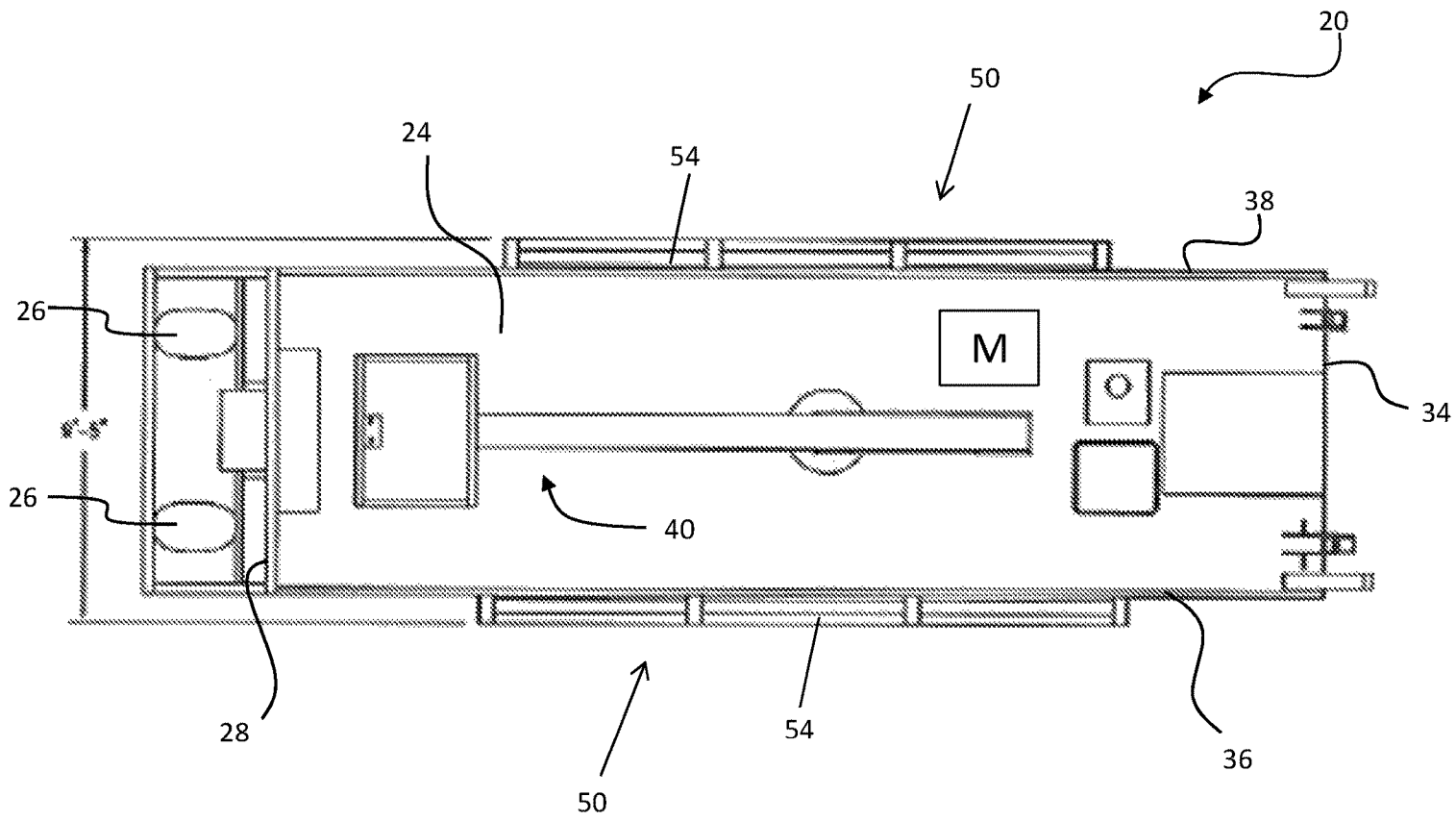
FIG. 2 is a top view of a watercraft in a stowed position according to an embodiment of the invention.
Figure 5:
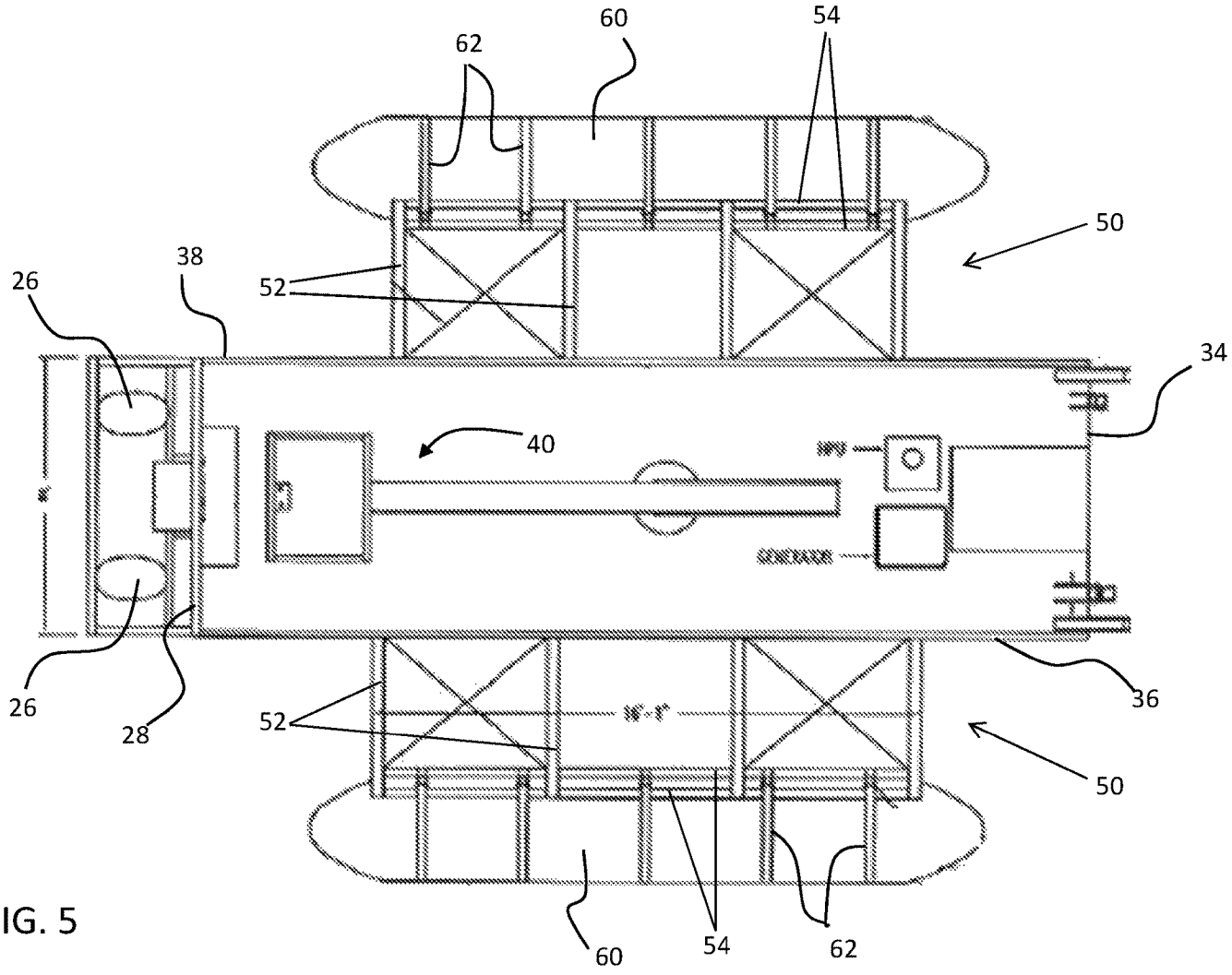
FIG. 5 is a top view of the a water vehicle in a deployed position according to an embodiment of the invention.
Figure 6:
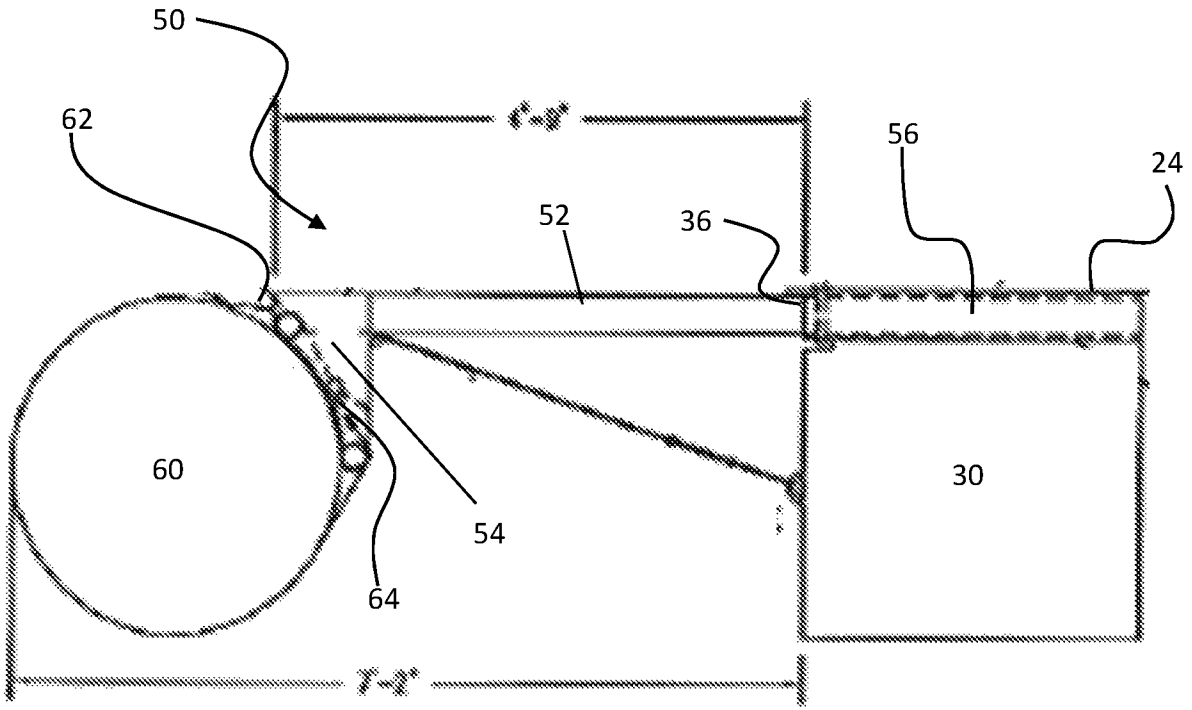
FIG. 6 is a cross-sectional view of a portion of a watercraft in a deployed position according to an embodiment of the invention.

The mounting brackets 50 are configured to slide or telescope between a retracted position (FIG. 2) and a deployed position (FIG. 5). In the retracted position, such as when the watercraft 20 is being transported or stowed for example, the mounting brackets 50 are at least partially received within complementary openings 56 formed in the sides 36, 38 of the deck 24. In the deployed position, such as when the watercraft 20 is in a body of water, the mounting brackets 50 extend outwardly from the sides 36, 38 of the deck 24, such as along a horizontal axis for example, such that the deployed mounting brackets 50 are generally coplanar with the deck 24. The mounting brackets 50 may be translated between the retracted and deployed positions either manually, such as by application of a force thereto, or alternatively, via a mechanical mechanism (illustrated schematically at M) arranged on the watercraft 20, such as a crank or a winch for example. As a result, the mounting brackets 50 may be moved between the retracted and deployed positions when the watercraft 20 is on land and also when the watercraft is in a body of water.

The watercraft 20 additionally includes a plurality of inflatable pontoons 60. The inflatable pontoons 60 are substantially identical and may be formed from a suitable inflatable material, such as neoprene or nylon which is commonly used in whitewater rafts for example. The inflatable pontoons 60 are generally smaller than the main pontoons 30 and may extend over only a portion of the length of the watercraft 20. The inflatable pontoon 60 is generally inflated with air, such as via a compressor or other mechanism arranged on the watercraft 20. The inflatable pontoons 60 may be inflated when the watercraft 20 is on land or in a body of water regardless of whether the mounting brackets 50 are in a retracted or deployed position.

Figure 7:
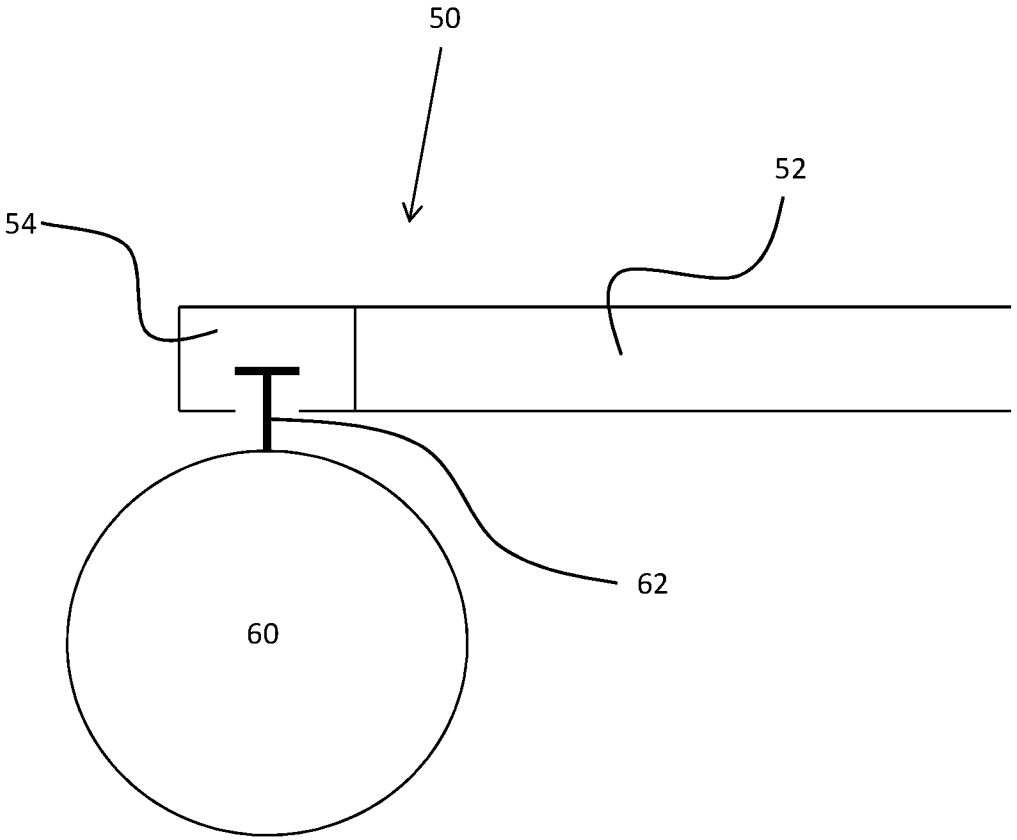
FIG. 7 is a detailed view of the connection between an inflatable pontoon and a mounting bracket according to an embodiment of the invention.

The inflatable pontoons 60 are removably coupled to each of the mounting brackets 50. In one embodiment, illustrated in FIG. 7, at least one first connector 62, such as a T-shaped connector for example, is coupled to the inflatable pontoon 60. The first connector 62 is generally complementary to a portion, such as an opening, formed in the connection member 54 of the mounting bracket 50, such that the first connector 62 may slidably couple to the connection member 54.

Figure 8:
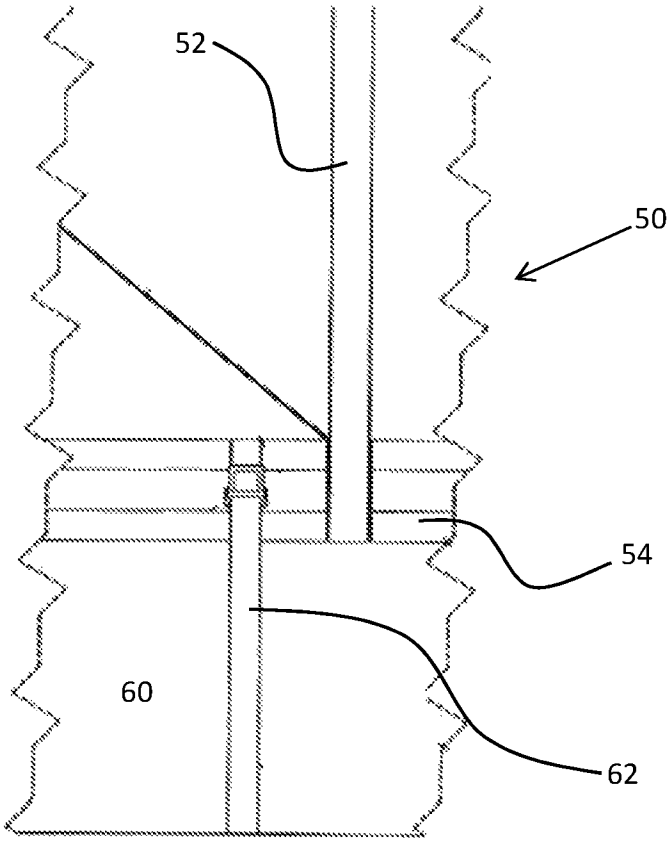
FIG. 8 is a detailed view of the connection between an inflatable pontoon and a mounting bracket according to an embodiment of the invention.

In another embodiment, illustrated in FIG. 8, the first connectors 62 are adjustable straps fastened, such as with stitching for example, to the inflatable pontoons 60. In one embodiment, the adjustable straps 62 include a ratchet mechanism 64 to prevent unintended loosening of the adjustable strap 62 from a desired position. The straps 62 are configured to surround the at least one connection member 54. By surrounding the at least one connection member 54 between adjacent support members 52, the adjustable straps 62 generally limit movement of the inflatable pontoon 60 relative to the mounting frame 50. Other configurations for coupling the inflatable pontoon 60 to the mounting bracket 50 not described herein are also within the scope of the invention.

During operation of the man lift 40 while the watercraft 20 is in a body of water, the mounting brackets 50 are arranged in the deployed position, and the inflatable pontoons 60 connected thereto are inflated. In this configuration, the inflatable pontoons 60 stabilize and minimize the sway of the watercraft 20 relative to the body of water to thereby improving the safety of a person contained in the man lift 40 raised vertically above the watercraft 20. After completion of an inspection and/or maintenance and once the man lift 40 is returned to a lowered position, the inflatable pontoons 60 may be deflated and/or the mounting brackets 50 may be retracted.

When the watercraft 20 is on land, for example during transport or when the watercraft 20 is being stowed, the mounting brackets 50 are retracted into the openings 56 in the deck 24, and the inflatable pontoons 60 are generally deflated and detached from the watercraft 20. In one embodiment, the separated inflatable pontoons are carried by the device or vehicle configured to transport the watercraft, such as a truck or trailer for example. By removing the inflatable pontoons 60 from the watercraft 20 when the watercraft 20 is not in use, the overall size envelope of the watercraft 20 is reduced and damage to the inflatable pontoons 60 may be prevented.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A watercraft configured for use in a body of water, comprising:

a deck;

at least one propulsion mechanism mounted at a first end of the deck, the at least one propulsion mechanism being configured to move the watercraft within the body of water;

a man lift mounted to the deck and movable between a lowered position and a raised position, the man lift being configured to raise a person a vertical distance above the deck;

mounting brackets arranged adjacent a first side and a second side of the deck, the mounting brackets being translatable between a retracted position and a deployed position, wherein in the deployed position, the mounting brackets extend outwardly from the first side and the second side, respectively; and an inflatable pontoon associated with each of the mounting brackets wherein the inflatable pontoon is removably coupled to the mounting brackets when the mounting brackets are in a deployed position.

2. The watercraft according to claim 1, wherein when the watercraft is not in use, the inflatable pontoons are detached and stored separately from the watercraft.

3. The watercraft according to claim 1, wherein when the man lift is in the vertical position, the mounting brackets are in a deployed position and the inflatable pontoons coupled thereto are inflated.

4. The watercraft according to claim 3, wherein the mounting brackets are configured to translate along a horizontal axis between the retracted position and the deployed position.

5. The watercraft according to claim 1, wherein in the retracted position, the mounting brackets are at least partially received within a complementary opening formed in the deck.

6. The watercraft according to claim 1, wherein the mounting brackets are moved manually.

7. The watercraft according to claim 1, wherein the mounting brackets are moved automatically by a mechanism arranged on the watercraft.

8. The watercraft according to claim 1, wherein the inflatable pontoons are substantially identical and extend over only a portion of a length of the watercraft.

9. The watercraft according to claim 8, wherein the watercraft includes a first main pontoon positioned adjacent the first side of the deck and a second main pontoon positioned adjacent a second side of the deck.

10. The watercraft according to claim 1, further comprising at least one main pontoon mounted to an underside of the deck.

11. The watercraft according to claim 10, wherein the at least one main pontoon is formed from a sheet metal material.

12. The watercraft according to claim 10, wherein a front portion of the at least one main pontoon tapers generally upwardly toward a second end of the watercraft.

13. The watercraft according to claim 1, wherein the inflatable pontoons may be inflated or deflated regardless of whether the mounting brackets are in a retracted position or a deployed position.

14. The watercraft according to claim 1, wherein the mounting brackets may be moved between a retracted position and a deployed position regardless of whether the inflatable pontoons removably coupled thereto are inflated or deflated.

* * * * *